US006210558B1

(12) United States Patent
Demertzis et al.

(10) Patent No.: US 6,210,558 B1
(45) Date of Patent: Apr. 3, 2001

(54) STEEL PICKLING PROCESS IN WHICH THE OXIDATION OF THE FERROUS ION FORMED IS CARRIED OUT ELECTROLYTICALLY

(75) Inventors: Ioannis Demertzis, Milan; Paolo Giordani, Crema; Cesare Pedrazzini, Milan; Maurizio Busnelli, Saronno, all of (IT)

(73) Assignees: Henkel Kommanditgesellschaft auf Aktien, Duesseldorf-Holthausen (DE); Acciai Speciali Terni S.p.A., Saronno (IT)

( * ) Notice: Subject to any disclaimer, the term of this patent is extended or adjusted under 35 U.S.C. 154(b) by 0 days.

(21) Appl. No.: 09/180,259

(22) PCT Filed: May 7, 1997

(86) PCT No.: PCT/EP97/02346

§ 371 Date: Jan. 11, 1999

§ 102(e) Date: Jan. 11, 1999

(87) PCT Pub. No.: WO97/43463

PCT Pub. Date: Nov. 20, 1997

(30) Foreign Application Priority Data

May 9, 1996 (IT) ..... MI96A0936

(51) Int. Cl.[7] ..... C25B 1/22

(52) U.S. Cl. ..... 205/746; 205/749; 205/760; 205/761

(58) Field of Search ..... 205/749, 746, 205/760, 761

(56) References Cited

U.S. PATENT DOCUMENTS 3,844,927 * 10/1974 Smith ..... 204/630
4,113,588 * 9/1978 Watanabe et al. ..... 205/749

* cited by examiner

*Primary Examiner*—Arun S. Phasge
(74) *Attorney, Agent, or Firm*—Hedman & Costigan, P.C.

(57) ABSTRACT

Stainless steel pickling process in which a pickling solution containing HF and $Fe^{3+}$ ions as essential components is used, and wherein the oxidation to $Fe^{3+}$ of the $Fe^{2+}$ formed during the process in order to maintain the $Fe^{3+}$ concentration to the predetermined value, is electrolytically carried out by submitting the pickling solution as it is to an oxidation process in an electrolytic cell equipped with anode made of inalterable materials chosen among graphite, granular coal, lead and with cathodes made of stainless steel, graphite or other unalterable materials, said cell working with an applied tension between 1 and 8 V and with an anodic current density between 0.4 and 15 A/dm$^2$.

14 Claims, 2 Drawing Sheets

STEEL PICKLING PROCESS IN WHICH THE OXIDATION OF THE FERROUS ION FORMED IS CARRIED OUT ELECTROLYTICALLY

This application is a 371 of PCT/EP97/02346 filed May 7, 1997.

FIELD OF THE INVENTION

Object of the present invention is the achievement of a steel pickling process and particularly of a stainless steel one, carried out in a bath containing as essential components HF and ferric ions, in which the oxidation of $Fe^{2+}$ formed during the pickling process to $Fe^{3+}$ necessary in order to maintain the Redox potential of the solution at the predetermined value, is carried out by an electrolytic oxidation method acting directly on the pickling solution exactly as it is, preferably in a continuous way.

The electrolytic oxidation method according to the present invention can be advantageously applied to all the known pickling processes, the electrolytic oxidation of $Fe^{2+}$ to $Fe^{3+}$ in the pickling solution can replace the traditional oxidation methods of $Fe^{2+}$ to $Fe^{3+}$ by chemical oxidizers such as for instance $H_2O_2$, peracids, persalts, chlorates, oxygen (air), $HNO_3$.

TECHNOLOGICAL BACKGROUND

The electrolytic oxidation of the $Fe^{2+}$ ions in an exhausted pickling solution in order to restore the necessary concentration of $Fe^{3+}$ ions has been already disclosed by U.S. Pat. No. 3,622,478 for the treatment of a pickling solution based on $H_2SO_4$ and $Fe^{3+}$ ions introduced in starting solution as Ferric sulphate. The treatment is carried out in an electrolytic cell without separation between the catholyte and the anolyte (cell without separating diaphragm).

In FR 2.341.669 it is disclosed the electrolytic oxidation of $Fe^{2+}$ ions in an exhausted pickling solution based on HCl and Fe chlorides, in order to restore the necessary concentration of $Fe^{3+}$ ions. The treatment is carried out in a cell provided by separating diaphragm.

The above mentioned process for electrolytic oxidation of $Fe^{2+}$ ions are relevant to pickling solutions based on $H_2SO_4$ or HCl and not containing HF or $F^-$ anions.

The presence of HF and $F^-$ anions in the pickling solution involves the formation of fluorinated complexes of trivalent iron and consequently the properties and behaviour of the solution is not equivalent to those of pickling solutions not containing HF (or $F^-$ anions).

Consequently the above prior art electrolytic oxidation methods cannot be considered obviously applicable to HF containing pickling solutions.

SUMMARY OF THE INVENTION

According to the present invention the conventional methods of chemical oxidation can be advantageously substituted, in order to restore the preestablished value of the ferric ions concentration defined by the sort of the pickling process and of the material to be treated by a method for the electrolytic oxidation of the pickling solution carried out batch-wise or continuously according to the requirements of the plant.

The solution to be treated can be cooled before entering in the electrolytic cell or can be treated at the same temperature of the pickling process. The electrolytic oxidation according to the present invention is carried out with two electrodes acting respectively as a cathode and as an anode in contact with the pickling solution to be oxidized, to which a continuous tension having a sufficient value for the oxidation of $Fe^{2+}$ to $Fe^{3+}$ to the anode and for the reduction of $H^+$ to gaseous $H_2$ to the cathode is applied.

DESCRIPTION OF THE DRAWINGS

In the diagrams of the FIGS. 1–4 it is reported the $Fe^{2+}$ content decrease with time, during the electrolytical oxidation process.

DETAILED DESCRIPTION OF THE INVENTION

Figure 1:
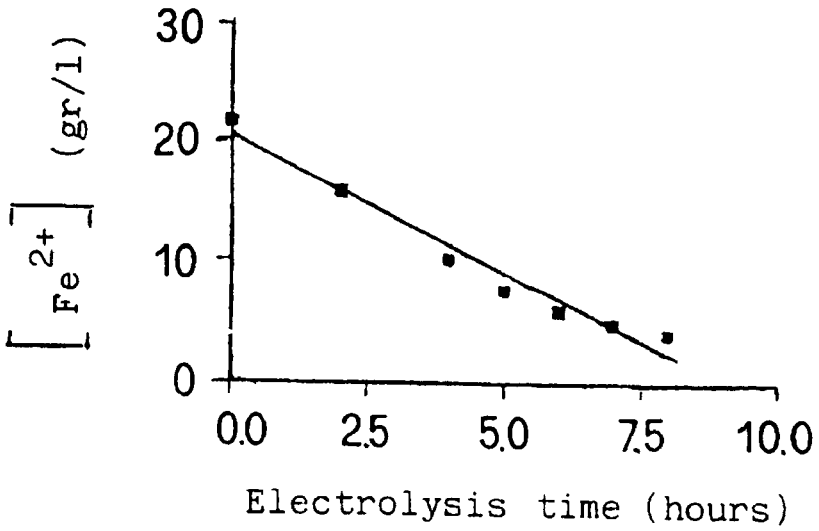

The process can be carried out in a proper electrolytic cell in which the solution coming from the pickling bath is continuously or discontinuously sent, said electrolytic cell being preferably equipped with a diaphragm to separate the cathodic area from the rest of the electrolyte. From the electrolytic oxidation tests of the pickling solution carried out the result showed that it is also possible to carry out the operation in a "single build" electrolytic cell that is without separating diaphragm of the cathodic area from the anodic one provided that the current density on the cathodic surface is very high, in the range of 400±50 $A/dm^2$ that is up to 100 times the anodic on the anodic one current density which is kept at values in the range from 0.4 to 15 $A/dm^2$ and mostly of the order of 4±0.5 A/dm.

As far as the tension applied to the electrodes is concerned, this one is related among other things to the intensity of the current flow that one wants to keep in the electrolytic cell. It is generally comprised between 1 and 8 V preferably between 1 and 5 V and more preferably between 1 and 3V.

The schematic representation of the electrolytic reoxidation of the pickling solution is shown in the following for the case of "single build" cell and of the "double build" cell (namely cell having diaphragm):

Single build cell

| cathodic reactions | | anodic reactions | |
|---|---|---|---|
| a) $H_3O^+ + e^- \longrightarrow$ | $\frac{1}{2}H_2 + H_2O$ | a) $Fe^{2+} \longrightarrow$ | $Fe^{3+} + e^-$ |
| b) $Fe^{3+} + e^- \longrightarrow$ | $Fe^{2+}$ | b) $H_2O \longrightarrow$ | $\frac{1}{2}O_2 + 2H^+ + 2e^-$ |

Double build cell

| cathodic reactions | | anodic reactions | |
|---|---|---|---|
| a) $H_3O^+ + e^- \longrightarrow$ | $\frac{1}{2}H_2 + H_2O$ | a) $Fe^{2+} \longrightarrow$ | $Fe^{3+} + e^-$ |
| | | b) $H_2O \longrightarrow$ | $\frac{1}{2}O_2 + 2H^+ + 2e^-$ |

a) = main reaction b) = parasitic reaction

The double build cell affords the highest conversion allowing an easier control of the possible parasitic reactions such as the reduction of $Fe^{3+}$ to $Fe^{2+}$.

In the double build cell the catholyte can be the same pickling solution provided that the volume of the catholyte is very limited in order to reduce at the most the amount of $Fe^{3+}$ therein contained (which is reduced to $Fe^{2+}$).

Of course it is preferred to utilize as a catholyte any aqueous solution, preferably acid, which does not contain metallic ions, in particular $Fe^{2+}$, which can be reduced at the cathode.

The catholyte solution can be restored in situ owing to the spontaneous inflow of hydrogen cations from the outside solution through the diaphragm, or can occurs through addition of acid solution from outside by pump at controlled flow rate. A proper example is an aqueous solution of $H_2SO_4$ owing to the low cost, the high electrolytic conductivity and limited corrosion effect on the building materials of the cell.

If the cathode is made of proper material the catholyte can be an aqueous solution of HF.

An embodiment economically advantageous consists in feeding in the cathodic compartment the exhausted pickling solution no more suitable for recycling in pickling bath which should be definitively discharged. Such a solution contains yet enough acidic components and acts well as catholyte having a good electrical conductivity.

In an industrial embodiment of the present invention double build cells in series arrangement can advantageously be of the type "bipolar electrode" wherein a face of the electrode acts as cathode in a cell and the opposite face of the same electrode acts as anode in the adjacent cell.

As far as the electrode material is concerned, platinum is certainly suitable thanks to its inalterability in the solution to be treated but it is obviously to be excluded in production plants for financial reasons.

As anode, any carbonaceous material or metallic material, possibly pretreated on the surface, can be used. In particular anodes made of graphite, glassy carbon, carbon felts and also metals for example lead after an activation surface treatment, come out to afford satisfactory results. Graphite can be also used as support for anodic materials consisting of particulate of graphite or of carbon felt.

The anode can be bidimensional in form of bar, plate and any other commercial form, or tridimensional in form of fixed or fluidized bed: particularly good results have been obtained with tridimensional anodes made of carbon felt, or made of graphite particulate in form of fixed or fluidized bed wherein the surface available for the electric change for a unitary volume of the anode results to be the maximum.

The cathode can be bidimensional or tridimensional and can be made of ferrous or carbonaceous materials or of a metal chosen amongst vanadium, tungsten, tantalium, niobium, yttrium, and in the case the process is carried out by excluding the presence of HF in the catholyte also amongst titanium and zirconium. Shape and size of the cathode are those required by the working conditions of the process.

In the case of a double build cell the separation between catholyte and anolyte is carried out by a porous diaphragm made of a material inert to the pickling solution or by a ions exchange membrane (cations or anions exchange). The diaphragm can be made of asbest or materials consisting of ceramic oxides or organic polymers suitable for the manufacture of fabrics, felts and microporous films. Such polymeric materials can be choosen among polyoxyphenylene, polyfluorovinyl, polyphenylensulfide, polyperfluoroalkoxyl, polytetrafluoroethylene. For the ion exchange membrane is suitable a matirial of the type perfluorosulphonic acid sold under the trade mark Nafion (Du Pont).

The process of electrolytic oxidation above disclosed can be carried out in a large range of temperature between ambient temperature and 100° C.: at high temperature the reaction speed is increased but the life of the electrodes is compromised. The preferred working temperature is comprised between 20° and 60° C.

The possibility of oxidizing in an electrolytic way the pickling solution within the scope of a stainless steel or common steel pickling process comes out of the laboratory tests carried out. From these tests the working conditions that can be applied within the scope of an industrial pickling process which uses a bath containing $Fe^{3+}$ ions and hydrofluoric acid or $HF+H_2SO_4$, are drawn.

The electrolytic oxidation method according to the invention is useful in the stainless steel pickling as well as in the pickling of other kind of steel where the $Fe^{2+}$ ion in the pickling solution is to be continuously oxidized to $Fe^{3+}$, for instance in the pickling of nickel-steels or nickel-cobalt steels according to the Japanese Uyemura's patent n. 235 581.

The pickling solutions which can be advantageously reoxidized by the electrolytic method according to the present invention are of different type.

We can mention in this connection the solutions containing as acid component only HF, generally comprised in the following limits:

HF between 10 and 60 g/l (as free acid)

$Fe^{3+}$ between 15 and 70 g/l anion $F^-$ total, between 30 and 140 g/l $Fe^{2+}+Fe^{3+}=80$ g/l $Fe^{3+}/Fe^{2+}=0.2+7$ Of particular interest are the pickling solutions used in the process Cleanox$^R$ of the Applicant wherein the composition can range between the following wide limits according to the type of the material to be treated and of the upstream manufacturing steps:

HF between 5 and 60 g/l (as free acid)

$H_2SO_4$ between 30 and 200 g/l (as free acid)

$Fe^{3+}$ between 5 and 80 g/l $Fe^{2+}$ between 4 and 80 g/l anion $F^-$ total between 5 and 150 g/l anion $SO_4^{--}$ total between 60 and 330 g/l $Fe^{3+}/Fe^{2+}$ between 0.05 and 20 g/l In order to avoid troubles owing to saturation of the bath in iron salts generally a total Fe content of 120 g/l is not exceeded. The above solution can contain, for specific uses, small amount of $Cl^-$ anions up to a maximum of 20 g/l.

It is possible also to treat pickling solutions containing:

HF between 5 and 60 g/l (as free acid)

HCl between 20 and 60 g/l (as free acid)

$Fe^{3+}$ between 5 and 80 g/l anion $F^-$ total between 5 and 150 g/l

A further application of the electrolytic oxidation method according to the invention consists in the reoxidation of solutions used in passivation treatments subsequent to the pickling process and having composition similar to those above considered for the pickling process.

The following tests and examples have illustrative purpose and do not limit the possible application of the invention process.

TEST 1

The "single build" cell was equipped with a 5.3×11 cm "screened" platinum anode having an actual total surface of 100 $cm^2$. The cathode made of platinum too having an actual surface of about 1 $cm^2$. The volume of the electrolytic solution was 100 ml. The solution in the test had the following composition:

HF=20.69 g/l $H_2SO_4$=71.2 g/l $Fe^{2+}$=41 g/l $Fe^{3+}$=32 g/l $Cr^{3+}$=2.7 g/l

The solution had a room temperature.

The applied tension was comprised between 1 and 2 V and it was set in order to maintain a constant current intensity of 1 A.

The Redox potential of the solution was measured at regular intervals of 15 minutes and it is reported in the following table:

| Electrolysis time (min.) | Measured Potential (Pt/SCE) |
|---|---|
| 0 minutes | 0.213 Volt |
| 15 minutes | 0.218 Volt |
| 30 minutes | 0.226 Volt |
| 45 minutes | 0.234 Volt |
| 60 minutes | 0.243 Volt |
| 75 minutes | 0.255 Volt |
| 90 minutes | 0.263 Volt |
| 105 minutes | 0.272 Volt |
| 120 minutes | 0.290 Volt |
| 135 minutes | 0.295 Volt |
| 150 minutes | 0.304 Volt |
| 165 minutes | 0.308 Volt |
| 180 minutes | 0.315 Volt |
| 195 minutes | 0.318 Volt |
| 210 minutes | 0.320 Volt |

Total growth of the potential=0.107 Volt.

TEST 2

The single "build" cell was equipped with a platinum anode as the one of test 1 and with an iron cathode having a cathodes surface/anodic surface of 1/100. The electrolytic solution volume was 1000 ml, the composition was the following one:

HF=46.6 g/l $H_2SO_4$=122.4 g/l $Fe^{2+}$=38.1 g/l $Fe^{3+}$=11.7 g/l

The solution has a room temperature. The applied tension was included between 1 and 2 V and it was set in such a way to obtain a 4 A constant current intensity.

After 60 minutes of electrolysis the analytic data compared with the initial ones are as follows:

| Content of $Fe^{2+}$ and $Fe^{3+}$ at the beginning, t = 0 minutes | Content of $Fe^{2+}$ and $Fe^{3+}$ at t = 60 minutes |
|---|---|
| $Fe^{2+}$ = 38.1 g/lt<br>$Fe^{3+}$ = 11.7 g/lt<br>Redox = 120 mV/Ag, AgCl | $Fe^{2+}$ = 31.8 g/l<br>$Fe^{3+}$ = 18 g/l<br>Redox = 150 mV/Ag, AgCl |

The results show that a quantity of 6.3 g of $Fe^{2+}$ is thus oxidized to $Fe^{3+}$ with a potential Redox increase of about 30 mV. From these data a 75% current efficiency is reckoned.

TEST 3

The "single build" cell was equipped with the same electrodes as in test 2, the volume of the electrolyte being of 1000 ml and the temperature being a room temperature.

The initial solution was as follows:

HF=46.6 g/l $H_2SO_4$=122.4 g/l $Fe^{2+}$=31.8 g/l $Fe^{3+}$=18 g/l

The applied tension was comprised between 1 and 2 V and it was set in such a way to have a 4 A constant intensity. After 60 minutes of electrolysis the analytic data compared with the initial ones are as follows:

| Content of $Fe^{2+}$ and $Fe^{3+}$ at the beginning, t =0 minutes | Content of $Fe^{2+}$ and $Fe^{3+}$ at the end of the electrolysis t = 60 minutes |
|---|---|
| $Fe^{2+}$ = 31.8 g/lt<br>$Fe^{3+}$ = 18 g/lt<br>Redox = 150 mV/Ag, AgCl | $Fe^{2+}$ = 26.4 g/l<br>$Fe^{3+}$ = 23.4 g/l<br>Redox = 183 mV/Ag, AgCl |

The results show the oxidation of 5.4 of $Fe^{2+}$ to $Fe^{3+}$ and a potential Redox increase of about 33 mV. From these data a 64% current efficiency is reckoned.

TEST 4

The used cell was equipped with platinum cathode and anode which were also used in test 1. The cell contained 80 ml of electrolyte and was equipped with a NAFION separating membrane of the cathodic area. The tension was set between 1 and 2 V so as to have a constant intensity of 0.5 A.

The initial electrolyte composition was the same as in test 1. At regular intervals of 15 minutes the Redox potential of the solution which is reported in the following table was measured.

| Electrolysis time | Potential of the solution measured by Pt/SCE electrode |
|---|---|
| 0 minutes | 0.22 Volt |
| 15 minutes | 0.268 Volt |
| 30 minutes | 0.308 Volt |
| 45 minutes | 0.344 Volt |
| 60 minutes | 0.364 Volt |
| 75 minutes | 0.384 Volt |
| 90 minutes | 0.398 Volt |
| 105 minutes | 0.412 Volt |
| 120 minutes | 0.414 Volt |

Total growth of the potential of the solution=0.194 Volt.

A comparison of the test 1 data with the test 4 ones showed a higher oxidation speed of $Fe^{2+}$ in the solution together with a higher current efficiency in test 4 than the one obtained in test 1. This is substantially due to the fact that in test 4 a cell provided with a diaphram for the separation of the cathodic area from the remaining electrolytic solution is used. A practical application of the electrolytic oxidation process of the pickling solution is shown in the following examples.

EXAMPLE 1

A pickling solution containing:

HF=25 g/l (as free acid)

$H_2SO_4$=110 g/l (as free acid)

$Fe^{2+}$=50.7 g/l $Fe^{3+}$=39.3 g/l is placed in an electrolytic cell having capacity of 700 ml, provided with separating diaphragm formed by a Nafion membrane, with anode and cathode of rectangular shape, made of graphite, having each working surface of 23.48 $cm^2$, and is subjected to electrolysis during 18 h. The tension applied to the cell was about 6 V (average value).

Working data and the results ascertained are reported in the following:

applied current: 0.92 A anode current density: 392 $A/m^2$ volume of the electrolysed solution: 700 ml initial $Fe^{2+}$ content in the treated solution: 30.1 g amount of $Fe^{2+}$ oxidized in g calculated by Faraday law: 34.5 g Faraday yield: 87.2% bivalent iron oxidation rate, $kg/m^3/day$=57.34

EXAMPLE 2

A pickling solution containing 40 g/l HF, $Fe^{3+}$ and $Fe^{2+}$ ions for a total of 40 g/l Fe, was subjected to electrolytic oxidation in a two-compartment cell provided with a separating diaphragm consisting of a Nafion ionic exchange membrane and with graphite electrodes. Two tests were carried out by varying some operating conditions. In both cases, a colloidal $Fe(OH)_3$ suspension was formed as a result of pH increase (due to protons migration toward the cathode compartment through the membrane). This phenomenon did not take place when treating pickling solutions also containing substantial quantities of $H_2SO_4$.

The operating conditions and the results of the first and second tests are reported hereinafter.

Figure 2:
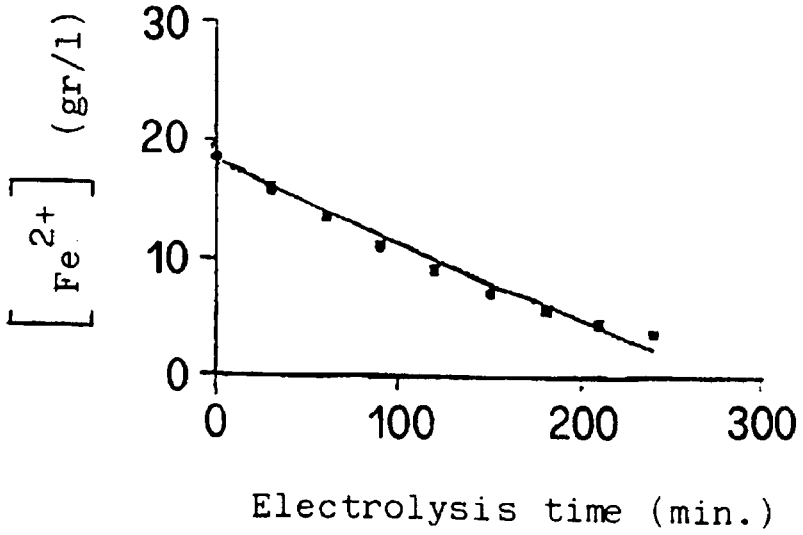

FIG. 1 and FIG. 2 show the $Fe^{2+}$ content variation with time, detected in the first and, respectively, in the second test.

Test 1 electrolysis total time: 8 h immersed anode area: 21.73 cm2 cell applied voltage: about 7V applied current, A: 0.9 anode current density, A/m2: 414 electrolysed solution volume: 700 ml initial $Fe^{2+}$ content in the treated volume: 21.77 g/l oxidized $Fe^{2+}$ quantity, g, referred to the treated solution volume: 17.76 g/l oxidized $Fe^{2+}$ quantity, g, calculated by the Faraday law: 21.42 g/l Faraday yield: 82.9% bivalent iron oxidation rate, kg/m3/day: 54.55

Test 2 electrolysis total time: 4 h immersed anode area: 21.73 cm2 applied current, A: 1.7 anode current density, A/m2: 782 electrolysed solution volume: 700 ml initial $Fe^{2+}$ content in the treated volume: 19.48 g/l oxidized $Fe^{2+}$ quantity, g, referred to the treated solution volume: 15.76 g/l oxidized $Fe^{2+}$ quantity, g, calculated by the Faraday law: 20.2 g/l Faraday yield: 77.9% bivalent iron oxidation rate, kg/m3/day: 93.4

A moderate oxygen evolution was observed in test 2. which was due to the high anode current density (7.82 A/dm2 vs. 4.14 A/dm2 of test 1).

In both tests, the $Fe^{2+}$ oxidation rate decreased with decreasing the concentration, which indicates a diffusion control on the kinetics of the whole electrolytic process.

EXAMPLE 3

This example has been carried out in an electrolytic cell having separating diaphragm made of Nafion ion exchange membrane of 100 $cm^2$ of surface. This comparatively large surface has been chosen in order to avoid the too high local current densities detected in some preceding tests (cell geometry optimisation). The pickling solution to be treated was as utilized in the Applicant's Cleanox$^R$ process and consisted of HF 40 g/l, $H_2SO_4$ 130 g/l, $Fe^{2+}$ 47.75 g/l, $Fe^{3+}$ 40 g/l. The catholyte consisted of a $H_2SO_4$ aqueous solution (127 g/l).

Catholyte (5 l) and anolyte (5 l) were contained in two separate container and let to circulate continuously respectively in the cathodic compartement and in the anodic compartement each of work capacity of about 0.5 l.

The test data are as follows:

catholyte volume: 5 l; anolyte volume: 5 l total immersed anode area: 168.68 cm2 total immersed cathode area: 84.34 cm2 applied current, A: 6.7 measured voltage across cell: 3.75 anode current density (theoretical), J: 398.8 A/m2 initial $Fe^{2+}$ content: 47.75 g/l final $Fe^{2+}$ content: 11.75 g/l total electrolysis time: 14 h Cleanox solution temperature during electrolysis: 40° C.

Faraday yield: 89.2%

Figure 3:
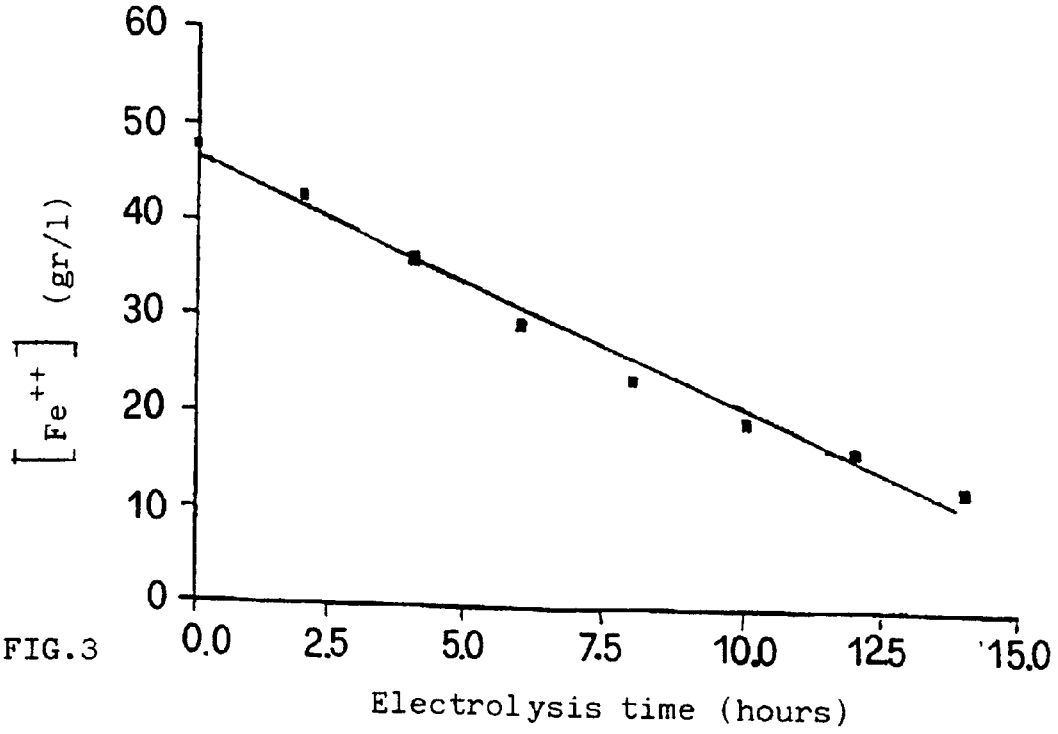

$Fe^{++}$ decrease with time is illustrated in the graph of FIG. 3.

Processing of the experimental data by a linear regression procedure gave an oxidation rate of 61.54 kg/m3/day.

Remarks

Once electrolysis had been completed, the graphite cylinders used as anodes did not show chemico-mechanical corrosion phenomena.

EXAMPLE 4

This test was carried out under the same operating conditions as adopted in Example 3 (NAFION membrane area: 100 cm2), introducing graphite particulate prepared in the lab into the anode compartment.

The test data are as follows:

catholyte volume: 5 l anolyte volume (Cleanox): 5 l total immersed anode area: 168.68 cm2+graphite particulate area: 600 cm2, total 770 cm2 total immersed cathode area: 84.34 cm2 applied current, A: 6.7 measured voltage across cell (mean): 2.8 initial $Fe^{2+}$ content: 43.00 g/l total electrolysis time: 12 h

Cleanox solution temperature during electrolysis: 40° C.

Faraday yield, $\pi_{farad}$: 93.4%

Figure 4:
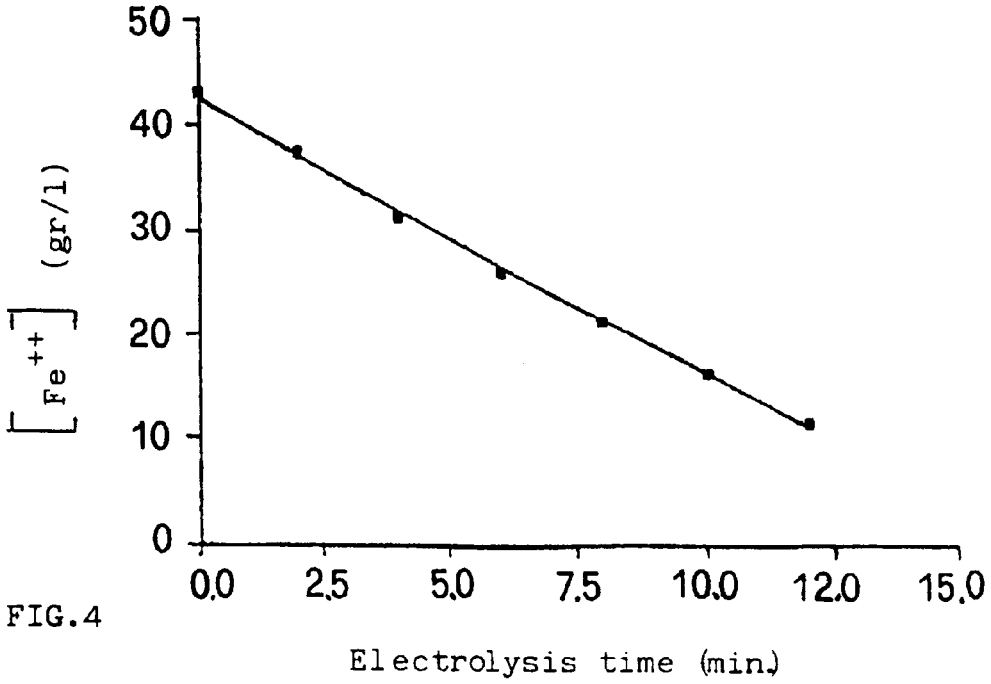

$Fe^{++}$ decrease with time is illustrated in the graph of FIG. 4.

Processing of the experimental data by a linear regression procedure gave an oxidation rate of 62.6 kg/m3/day.

Remarks

With this type of anode the energetic balance of the process improves with an average decrease of the cell voltage of 0.7 V.

EXAMPLE 5

A commercial-scale plant for the production of austenitic steel wire comprises a pickling stage consisting of a vat having a capacity of approx. 12,000 l and operating with a solution containing sulphuric acid *: 100 g/l,
hydrofluoric acid *: 30 g/l,
$Fe^{3+}$: 40 g/l,
$Fe^{2+}$: 25 g/l;
operating T: 50° C.
* concentration values referred to free acids.

To secure the highest efficiency of the pickling reaction, the solution was fed with an air flow of approx. 360 m3/h. The solution also contained chromium and nickel in an overall amount of approx. 12 g/l, deriving from the pickling reaction. During the process, the $Fe^{3+}/Fe^{2+}$ ratio had to be maintained at values ranging from 1.5 to 2.0.

Considering the plant productivity, to maintain said ratio at the predetermined values, approx. 300 kg of $Fe^{2+}$ (derived from the pickling reaction) was to be oxidized to $Fe^{3+}$ within a period of 12 h. Said operation had been formerly carried out by adding approx. 400 kg/day of Cleanox 352 Z ($H_2O_2$ stabilized at 28% by wt.).

The use of hydrogen peroxide has been now replaced by electrolytic oxidation according to the invention. The solution is continuously sent to a multiple electrolytic cell (filter press type) consisting of electrolytic cells in series provided with bipolar electrodes and including 16 anode semicells alternating with 16 cathode semicells, each being 1 m×1 m in size, separated by a NAFION semipermeable cationic membrane. The pickling solution, fed from a common header by means of a variable delivery pump (up to 5,000 l/h), after filtration continuously enters each anode semicell from the bottom (semicell working volume: 15 l), outflows from the top and then returns to the pickling vat.

The catholyte consists of a ca. 100 g/l sulphuric acid solution coming from an approx. 500 l adjacent tank, in which it is continuously recirculated. The electrode of bipolar type consists of a stiff plate, thickness of 1 cm, made of graphite.

The total cathode surface, like the anode one, is 16 $m^2$. Nafion membranes are placed between two polyethylene porous panels which serve as a reinforcement and prevent the membrane from being contaminated by suspended solids, if any.

A direct current flow corresponding to a current density on the electrode of about 4 $A/dm^2$ is caused to pass through each cell. The average voltage across the cell is 3 volts. The quantity of bivalent iron oxidized to trivalent iron averagely is comprised between 11 to 13 kg/h, with a $Fe^{3+}/Fe^{2+}$ ratio being maintained within the predetermined range.

What is claimed is:

1. Pickling process for stainless steel, wherein a pickling solution is used which contains as essential components HF and $Fe^{3+}$ ions, and the oxidation to $Fe^{2+}$ formed during the pickling process, in order to maintain the concentration of $Fe^{3+}$ at the predetermined value, is carried out electrolytically by subjecting the pickling solution as it comes out from the pickling bath to an anodic oxidation process in an electrolytic cell provided with anode made of a material inalterable to the anodic oxidation and characterized in that the electrolytic cell is provided with a diaphragm separating the cathodic area from the anodic one, said diaphragm being made of porous material or consisting of an ion exchange membrane, the anode is made of graphite or other carbonaceous materials, the cathode, suitable for the cathodic reduction of cations $H^+$ and consequent development of gaseous hydrogen, is made of ferrous or carbonaceous materials or of a metal chosen amongst zirconium, titanium, tantalum, tungsten, vanadium, and in that the cell voltage is comprised between 1 and 8 V and the anodic current density is comprised between 0.4 and 15 $A/dm_2$ and further characterized in that the thus obtained re-oxidized solution is recycled directly to the pickling bath.

2. Process according to claim 1, wherein the pickling solution to be re-oxidized is fed continuously to the electrolytic cell.

3. Process according to claim 1 wherein the pickling solution contains also $H_2SO_4$.

4. Process according to claim 1, wherein the pickling solution contains also $H_2SO_4$+HCl.

5. Process according to claim 1 wherein the pickling solution contains also HCl.

6. Process according to claim 1, wherein the separating, porous diaphragm is made of asbestos or of material consisting of ceramic oxides or of polymeric material chosen from: polyoxyphenylene, polyvinylfluoride, polyphenylensulfide, polyperfluoroalkoxy, polytetrafluoroethylene.

7. Process according to claim 1, wherein the diaphragm consist of an ion exchange membrane made of perfluorocarbon sulfonate sulfonic acid.

8. Process according to claim 1, wherein the pickling solution to be reoxidized is fed in the anodic compartment whereas into the cathodic compartment is fed an aqueous acid solution.

9. Process according to claim 8, wherein the solution fed into the cathodic compartment is an aqueous solution of $H_2SO_4$ and/or HF.

10. Process according to claim 8, wherein the aqueous acid solution fed into the cathodic compartment consists in the exhausted pickling solution no more suitable for recycling in the pickling bath.

11. Process according to claim 1 wherein the cell voltage is between 1 and 5 V.

12. Process according to claim 1 wherein electrolytic cells in series, provided with bipolar electrodes are used.

13. Process according to claim 1 wherein the electrolytic cells are provided with cathode made of stainless steel.

14. Process according to claim 1 wherein the pickling solution is comprised in the following limits:

HF between 5 and 60 g/l (as free acid)
$H_2SO_4$ between 30 and 200 g/l (as free acid)
$Fe^{3+}$ between 4 and 80 g/l
$Fe^{2+}$ between 4 and 80 g/l
anion $F^-$ total between 5 and 150 g/l
anion $SO_4^{--}$ total between 60 and 330 g/l
$Fe^{3+}/Fe^{2+}$ between 0.05 and 20.

* * * * *